US008459357B2

(12) United States Patent
Dewey et al.

(10) Patent No.: US 8,459,357 B2
(45) Date of Patent: Jun. 11, 2013

(54) MILLING SYSTEM AND METHOD OF MILLING

(75) Inventors: Charles H. Dewey, Houston, TX (US); Praful C. Desai, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 334 days.

(21) Appl. No.: 12/772,781

(22) Filed: May 3, 2010

(65) Prior Publication Data

US 2010/0276145 A1 Nov. 4, 2010

Related U.S. Application Data

(60) Provisional application No. 61/175,182, filed on May 4, 2009.

(51) Int. Cl.
*E21B 29/06* (2006.01)
*E21B 29/00* (2006.01)

(52) U.S. Cl.
CPC ..... *E21B 29/002* (2013.01)
USPC ..... 166/298; 166/55.7

(58) Field of Classification Search
USPC ..... 166/298, 55.7; 175/430
See application file for complete search history.

(56) References Cited

U.S. PATENT DOCUMENTS 4,266,621 A 5/1981 Brock
5,131,468 A * 7/1992 Lane et al. ..... 166/120
5,657,820 A 8/1997 Bailey et al.
5,771,972 A 6/1998 Dewey et al.
5,979,571 A * 11/1999 Scott et al. ..... 175/61
6,082,223 A * 7/2000 Tibbitts ..... 76/108.2
6,102,123 A 8/2000 Bailey et al.
6,105,694 A 8/2000 Scott
6,568,492 B2 * 5/2003 Thigpen et al. ..... 175/408
6,612,383 B2 9/2003 Desai et al.
6,648,068 B2 11/2003 Robin et al.
7,025,156 B1 * 4/2006 Caraway ..... 175/426
7,178,609 B2 * 2/2007 Hart et al. ..... 175/61
7,207,401 B2 4/2007 Dewey et al.
2001/0035302 A1 * 11/2001 Desai et al. ..... 175/61
2008/0035380 A1 2/2008 Hall et al.
2008/0099250 A1 5/2008 Hall et al.
2008/0314645 A1 12/2008 Hall et al.
2008/0314647 A1 * 12/2008 Hall et al. ..... 175/430
2010/0319996 A1 * 12/2010 Reese ..... 175/57

OTHER PUBLICATIONS

International Search Report with Written Opinion issued in corresponding International Application No. PCT/US2010/033386 dated Dec. 30, 2010 (12 pages).

* cited by examiner

*Primary Examiner* — William P Neuder
(74) *Attorney, Agent, or Firm* — Osha Liang LLP

(57) ABSTRACT

A mill for milling a window through metal casing in a well bore that includes a body having a plurality of blades; a plurality of cylindrically bodied cutting elements on said blades; and a plurality of diamond enhanced elements having a non-planar diamond working surface on said blades; wherein said cutting elements initiate cutting into said casing and mill said window into said well bore.

27 Claims, 7 Drawing Sheets

MILLING SYSTEM AND METHOD OF MILLING

CROSS-REFERENCE TO RELATED APPLICATIONS

This applications claims priority to U.S. Patent Application No. 61/175,182, filed on May 4, 2010, which is herein incorporated by reference in its entirety.

BACKGROUND OF INVENTION

1. Field of the Invention

Embodiments disclosed herein relate generally to a downhole mill assembly. More particularly, the embodiments disclosed herein relate to a downhole mill assembly and a method of milling using diamond enhanced elements.

2. Background Art

When an existing cased oil well becomes unproductive, the well may be sidetracked in order to develop multiple production zones or redirect exploration away from an unproductive zone. Generally, sidetracking involves the creation of a window in the well casing by milling the steel casing in an area either near the bottom or within a serviceable portion of the well. The milling operation is then followed by the directional drilling of rock formation through the newly formed casing window. Sidetracking enables the development of a new borehole directionally oriented toward productive hydrocarbon sites without moving the rig, platform superstructure, or other above ground hole boring equipment, and also takes advantage of a common portion of the existing casing and cementing in the original borehole.

Thus, sidetracking is often preferred because drilling, casing, and cementing the borehole are avoided. As mentioned above, this drilling procedure is generally accomplished by either milling out an entire section of casing followed by drilling through the side of the now exposed borehole, or by milling through the side of the casing with a mill that is guided by a wedge or "whipstock" component.

The casing window is generally created with a combination of mills mounted on a shaft or mandrel at the bottom end of a drill string and wedging between the casing and a whipstock, which is generally set in the hole in combination with the first milling run. The peripheral surface of mills is generally covered with abrasive or cutting inserts made of hard material such as sintered tungsten carbide compounds brazed on a steel shaft. The hardness of the whipstock is generally designed so that minimum wear will be generated by the rotation of mills peripheral surface onto the whipstock face while the assembly is pushed and rotated against the casing wall under deflecting action of the whipstock. The milling action generally results from unbalanced pressures between the mill(s) and the whipstock on one hand and the mill(s) and the casing wall on the other hand.

U.S. Pat. No. 4,266,621, which is herein incorporated by reference, describes a milling tool for elongating a laterally directed window in a well casing. The disclosed system requires three trips into the well, beginning with the creation of an initial window in the borehole casing, the extension of the initial window within a particular cutting tool, and the elongation and further extension of the window by employing an assembly with multiple mills. While the window mill is aggressive in opening a window in the casing, the number of trips, typically three, to accomplish the task is expensive and time consuming.

By integrating a whipstock into the milling operation and directionally orienting the milling operation to a more confined area of well casing, the number of trips required to effectively mill a window in a well casing has been decreased. A whipstock having an acutely angled ramp is first anchored inside a well and properly oriented to direct a drill string in the appropriate direction. A second trip is required to actually begin the milling operations. Newer methods integrate the whipstock with the milling assembly to provide a combination whipstock and staged sidetrack mill, allowing for casing windows to be milled in one trip. The milling assembly is connected at its leading tool to the top portion of the whipstock by a bolt, which upon application of sufficient pressure, may be sheared off to free the milling assembly. The cutting tool employed to mill through the metal casing of the borehole has conventionally incorporated cutters that include at least one material layer, such as preformed or crushed tungsten carbide, designed to mill pipe casing. Several such one-trip milling systems include those described in U.S. Pat. Nos. 5,771,972, 6,102,123, 6,648,068, which are herein incorporated by reference in their entirety.

Conventional milling systems are, however, unable to mill windows in chrome casings, casings which are steadily increasing in number of wells due to the number of wells in severe drilling environments, such as severely corrosive environments, deep wells, cold environments, and sea bottoms, that are more commonly drilled due to exhaustion of easily drillable wells. The presence of and exposure to corrosive fluid, necessitates the use of corrosion resistant alloys (CRA), frequently duplex chrome, in the downhole components including casings. Other typically corrosion and/or erosion resistant CRA-type materials include: (1) stainless steel including conventional austenitic, martensitic, precipitation hardened, duplex, and ferritic stainless steels; (2) precipitation hardened and solid solution nickel-based alloys and nickel copper alloys; and (3) cobalt-based, titanium, and zirconium alloys. Although desired corrosion resistance can be obtained, for example, using a 25% duplex chrome, the material proves to be difficult in handling, specifically, in cutting and machining. The material tends to be abrasive to cutting tools, as well as leading to work hardening, smearing, galling, and welding. The difficulties associated with milling through a chrome casing leaves many mature wells neighbored by significant quantities of oil otherwise unreachable without the cost of either pulling the chrome casings and recompleting the existing well or forming a new well. The ability to sidetrack a well would not only allow for a multilateral well, but would also allow for sidetracking of a stuck drill string.

Furthermore, as the mill cutting structure meets the casing wall, the cutting structure typically encounters severe vibrations that frequently lead to cracks in the cutters. Such cracks may lead to failure of the cutters, reducing the life of the mill and likely preventing the mill from being used to drill through the sidetracked, secondary borehole (through the earth formation) after the window is milled.

However, further improvements in milling systems would allow for increased longevity of mills in an operational environment that frequently leads to failure of mills by cracking of cutters.

SUMMARY OF INVENTION

In one aspect, embodiments disclosed herein relate to a mill for milling a window through metal casing in a well bore that includes a body having a plurality of blades; a plurality of cylindrically bodied cutting elements on said blades; and a plurality of diamond enhanced elements having a non-planar diamond working surface on said blades; wherein said cutting elements initiate cutting into said casing and mill said window into said well bore.

In another embodiment, embodiments disclosed herein relate to a mill for milling a window through metal casing in a well bore that includes a body having a plurality of blades; a plurality of diamond enhanced elements having a non-planar diamond working surface on said blades; wherein said diamond enhanced elements initiate cutting into said casing and mill said window into said well bore.

In yet another aspect, embodiments disclosed herein relate to a method of milling a window in a casing in a wellbore that includes rotating a mill having a body with a plurality of blades, and a plurality of diamond enhanced elements having a non-planar diamond working surface on said blades; cutting a window in the metal casing with the mill; and passing the mill through the window.

In yet another aspect, embodiments disclosed herein relate to a mill for milling a window through metal casing in a well bore that includes a body having a plurality of blades; and a plurality of elements have a non-planar, conical working surface; wherein said elements initiate cutting into said casing and mill said window into said well bore.

Other aspects and advantages of the invention will be apparent from the following description and the appended claims.

DETAILED DESCRIPTION

Embodiments of the present disclosure relate to a milling assembly having at least one diamond enhanced or conical shaped element (located on a mill). Such mill may be used to mill a window in well casing and/or liner or open hole completion wells and, optionally, subsequently drill rock formation without the sequential removal of the milling assembly and replacement with a drilling assembly. As used herein, "casing" refers to steel pipe placed in a wellbore from approximately the ground surface, and "liner" refers to steel pipe placed in a wellbore and suspended from some level (referred to as a liner hanger point) below the ground surface. Typically, casing and/or liner is cemented in the wellbore with a cement grout. However, as both casing and liner are steel pipe, any reference to casing equally refers to casing or liner, and is only used for simplicity.

Figure 1A:
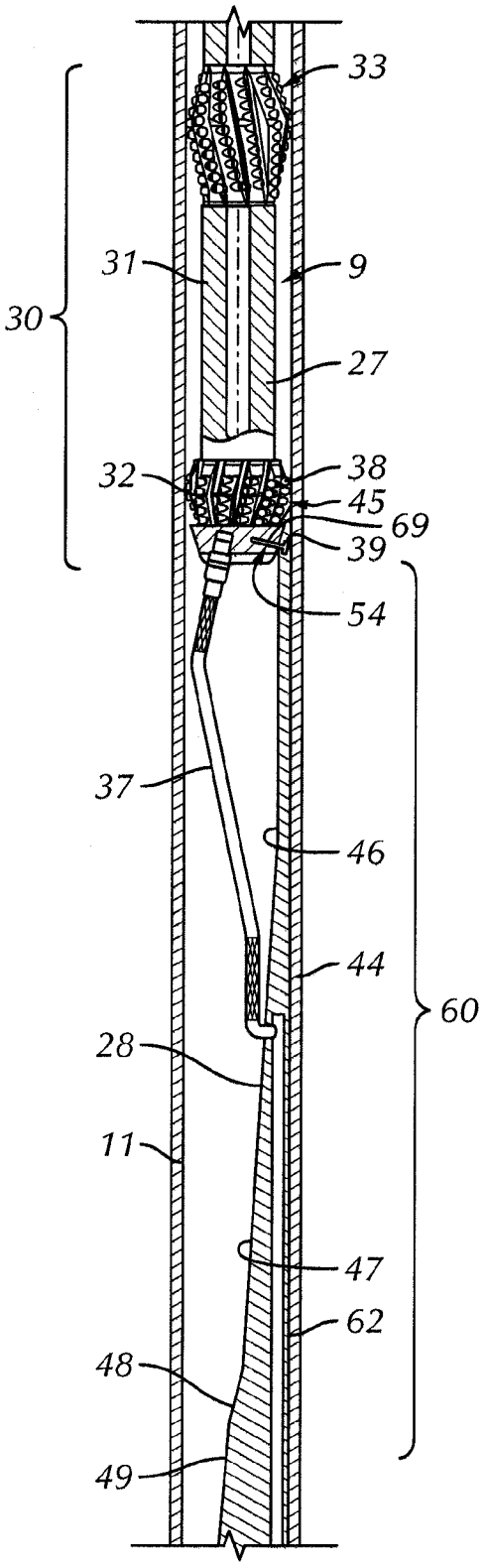
FIGS. 1A and 1B shows a mill assembly according to one embodiment disclosed herein.
Figure 1B:
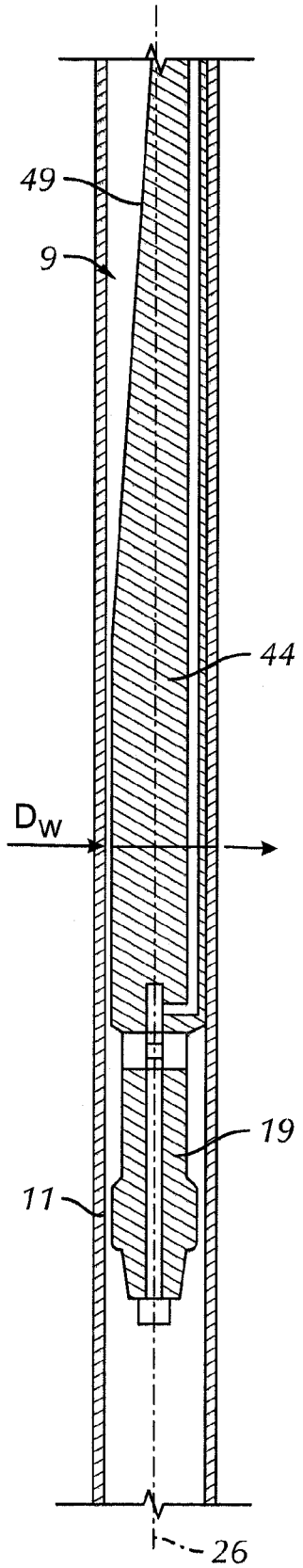

Referring briefly to FIGS. 1A and 1B, a milling assembly 30, in accordance with embodiments of the present disclosure, may include a lead mill generally designated as 32, which is attached to the bottom end of a shank or shaft 31, designed to sidetrack (by virtue of whipstock assembly 60) through casing 11. In addition to lead mill 32, milling assembly may include a series of tools and other components between the lead mill 32 and the drill pipe (not shown), described in greater detail hereinafter.

Figure 2:
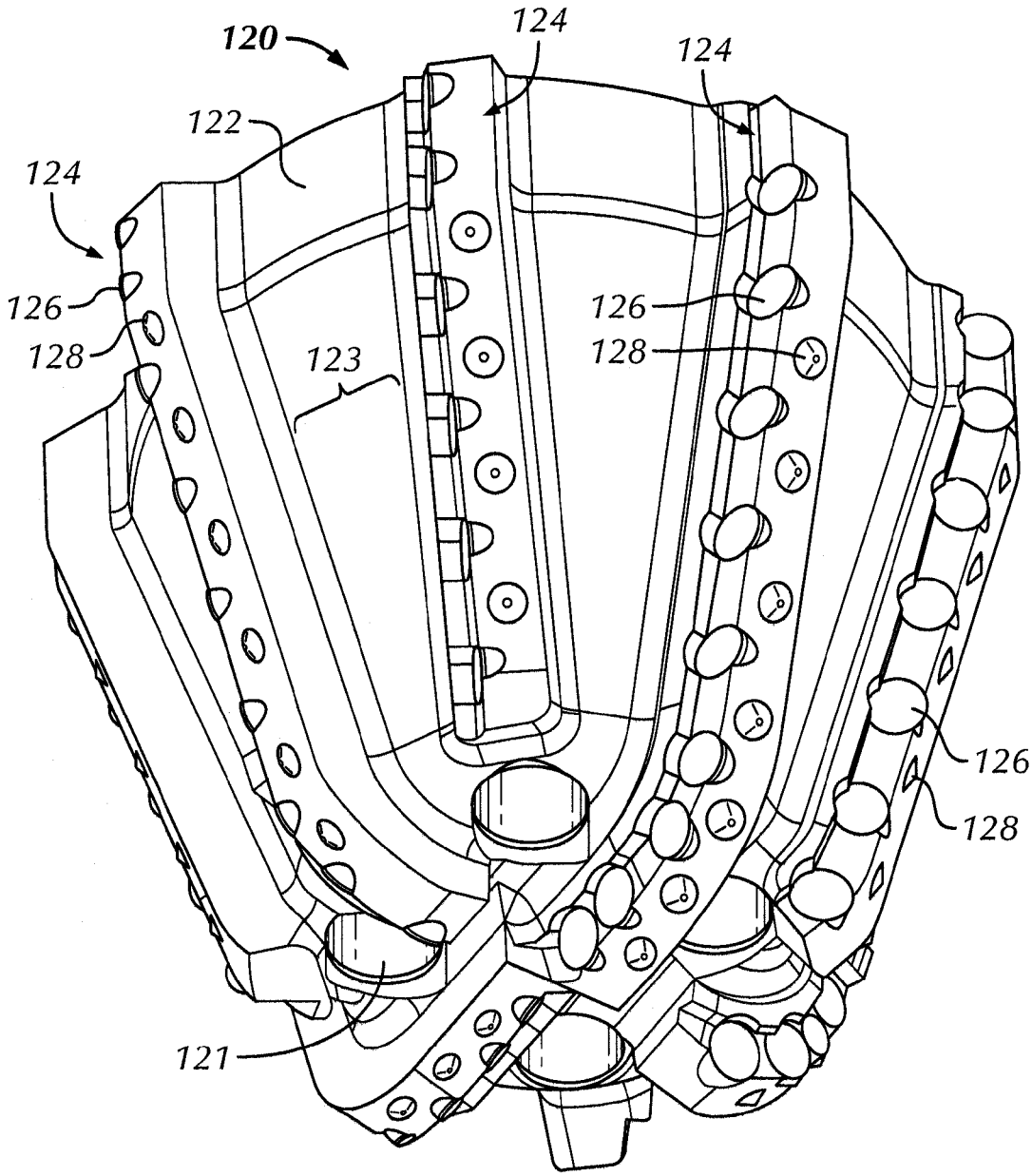
FIG. 2 shows a perspective view of a lead mill according to one embodiment disclosed herein.

In accordance with embodiments of the present disclosure, at least one diamond enhanced element may be provided on at least one mill of a milling assembly. As used herein, the term diamond enhanced elements refers to an element having a non-planar diamond working surface. Referring to FIG. 2, one embodiment of a mill having a diamond enhanced element located therein in shown. As shown in FIG. 2, a lead mill 120 includes a body 122 and a plurality of arched projections or blades 124 extending radially outward from body 122 to form the milling surface. Blades 124 include a plurality of cutting elements 126 and a plurality of diamond enhanced elements 128. Within the body 122 are one or more passages ending in openings 121 through which drilling fluid may be delivered to cool the tool surface and remove accumulated debris. Fluid may flow along channels or slots 123 defined as the passageways between neighboring blades 124. As shown in FIG. 2, cutting elements 126 are secured in cutter pockets (such as by brazing) formed in blade 124 at its leading edge (in the direction of rotation of the mill) to receive cutting elements 126 therein. Cutting elements 126 are cylindrically bodied cemented tungsten carbide elements with a layer of polycrystalline diamond (PCD) optionally forming the cutting surface thereof. When used with a PCD layer, cutting elements 126 are similar to polycrystalline diamond compact (PDC) cutters used in the art of fixed cutter, PDC bits, also often referred to as cutters or shear cutters. Such PDC cutters having a planar working or upper surface and may operate to scrape the casing 11 (shown in FIGS. 1A and 1B) so that window may be formed therein. In an alternative embodiment, cutting elements 126 may be cylindrically bodied cemented tungsten carbide elements made from metal cutting grade of tungsten carbide, which one of ordinary skill in the art should appreciate to include those tungsten carbide grades generally used in the machine shop operations, as compared to tungsten carbide grades conventionally used in cutting elements for drill bits.

The diamond enhanced elements 128 (variations of which are shown in FIGS. 3A-3D) also provided on mill 120 possess a diamond layer 132 on a substrate 134 (such as a cemented tungsten carbide substrate), where the diamond layer 132 forms a non-planar diamond working surface (specifically, a conical working surface as shown in FIG. 2). Diamond enhanced elements 128 may be formed in a process similar to that used in forming diamond enhanced inserts (used in roller cone bits) or may include formation of the non-planar end of the element (that includes a diamond layer 132 on a substrate 134), which is then joined to a base 136 such as by brazing or other attachment mechanisms known in the art. The interface (not shown separately) between diamond layer 132 and substrate 134 may be non-planar or non-uniform, for example, to aid in reducing incidents of delamination of the diamond layer 132 from substrate 134 when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a critical zone that encompasses the primary contact zone between the diamond enhanced element and the casing. Additional shapes and interfaces that may be used for the diamond enhanced elements of the present disclosure include those described in U.S. Patent Publication No. 2008/0035380, which is herein incorporated by reference in its entirety.

As used in the embodiments of the present disclose, it also within the scope that element 128 may be non-diamond based, and thus, may have a tungsten carbide conical working surface. It is also within the scope of the present disclosure that any of diamond enhanced elements 128 shown in FIGS. 2, 5 and 6 may be replaced with a cemented tungsten carbide conical-shaped element.

As used in mill 120, diamond enhanced elements 128 are placed rearward or behind cutting elements 126 (from the leading edge or face of blade 122), and are located in holes formed in blade 124. Such elements 128 may be secured in place through interference fit, brazing, or any other type of available retention mechanism.

Additionally, while diamond enhances elements 128 are shown as staggered with cutting elements 126 in the embodiment shown in FIG. 2, depending on the width of the blades 124, it may also be desirable to place the diamond enhanced elements 128 directly behind cutting elements 126 or alternate diamond enhanced inserts 128 with cutting elements along the leading face.

Figure 4:
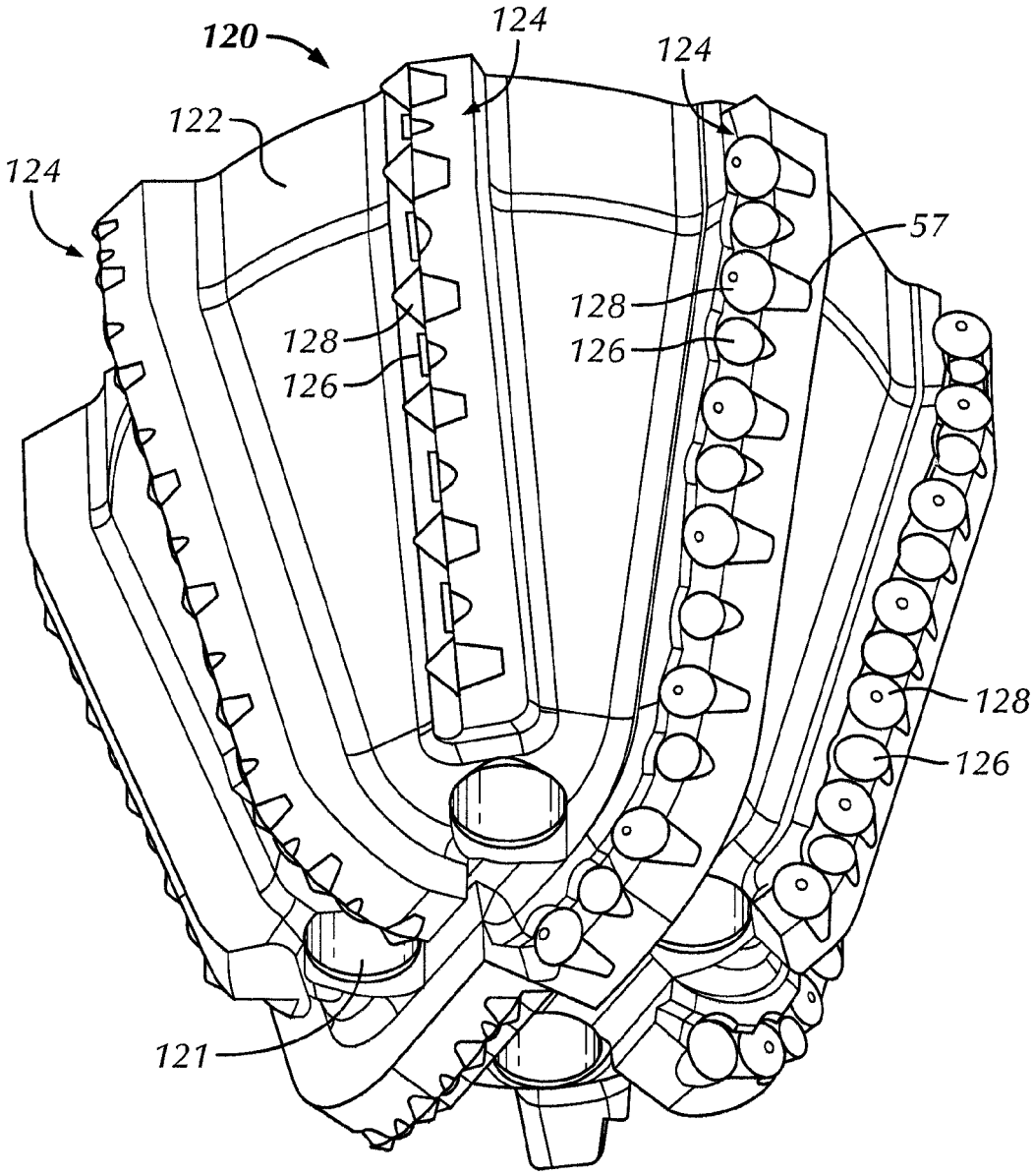
FIG. 4 shows a perspective view of a lead mill according to one embodiment disclosed herein.

Further, while the embodiment shown in FIG. 2 shows the diamond enhanced elements 128 being secured to blade 124 such that the plane tangential to the apex of the diamond enhanced elements 128 is approximately 90 degrees to the plane of the cutting end of the cutting element 126. However, the present invention is not so limited. Rather, the plane tangential to the apex of the diamond enhanced elements 128 may be at any angle with respect to that the cutting end plane of cutting elements 126. For example, as shown in FIG. 4, diamond enhanced elements 128 may be located in cutter pockets, similar to cutting elements 126, formed in blades 124, such that the plane tangential to the apex of diamond enhanced elements 128 is approximately co-planar or parallel with the cutting end plane of cutting elements 126. Further, it is also within the scope of the present disclosure that such planes may be at any angle between 0 and 90 degrees. While FIG. 4 shows alternating cutting elements 126 and diamond enhanced elements 128 along a blade profile, it is also within the scope of the disclosure that other sequences or patterns between elements 126 and 128 may be used.

Figure 5:
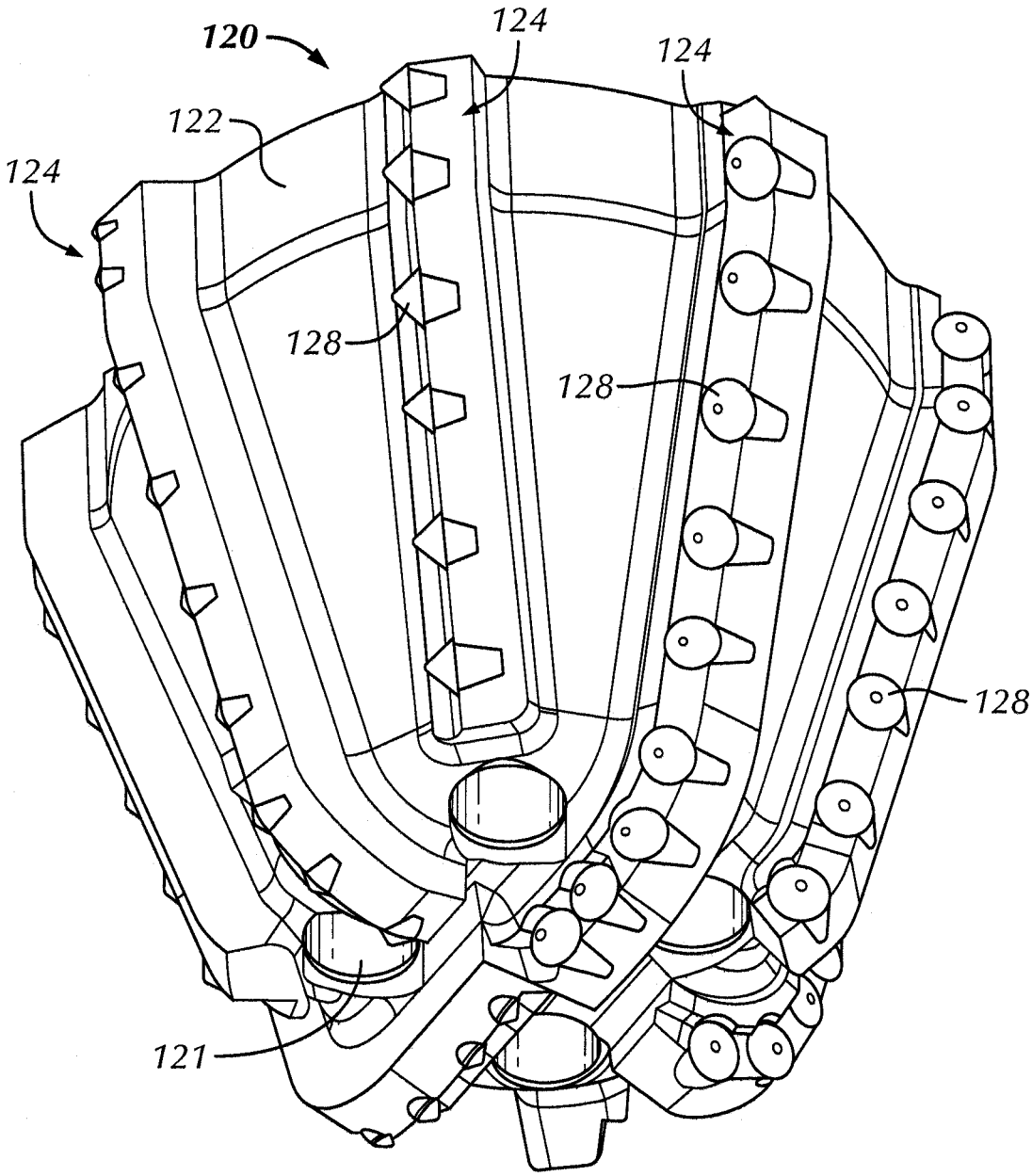
FIG. 5 shows a perspective view of a lead mill according to one embodiment disclosed herein.

Referring to FIG. 5, another embodiment of the present disclosure is shown. As shown in FIG. 5, mill 120 includes a body 122 and a plurality of arched projections or blades 124 extending radially outward from body 122 to form the milling surface. Blades 124 include a plurality of diamond enhanced elements 128 having a non-planar diamond working surface. Thus, in this embodiment, there are no planar working surface cutting elements provided on the mill. Rather, the cutting of the casing by mill 120 is solely performed by diamond enhanced inserts 128 having a diamond non-planar working surface.

Figure 3A:
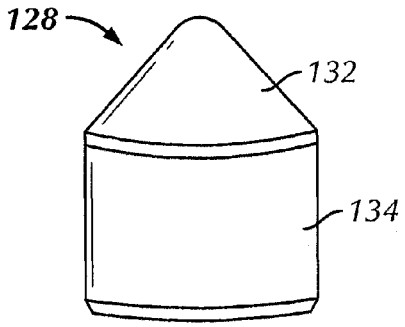
FIGS. 3A-3D show various embodiments of diamond enhanced elements according to the present disclosure.
Figure 3B:
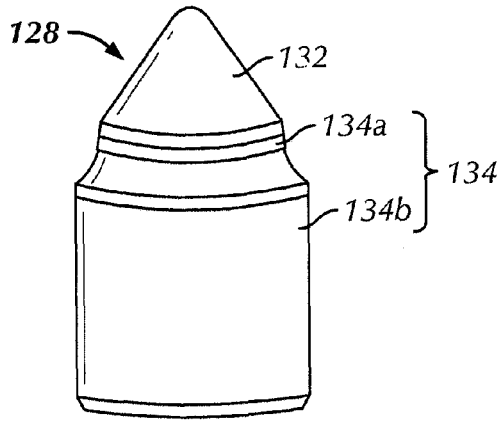
Figure 3C:
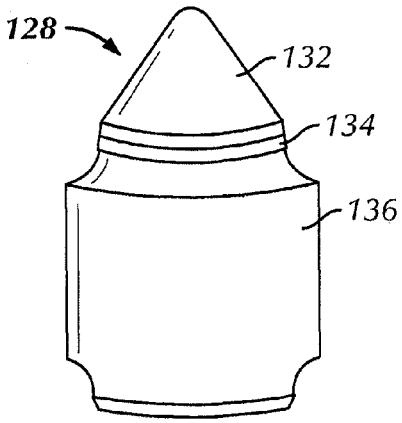
Figure 3D:
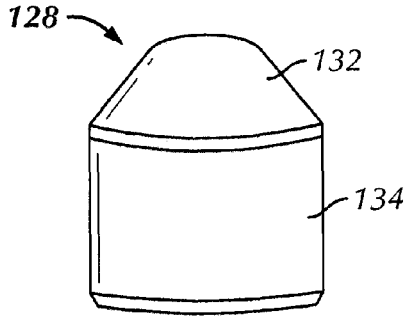
Figure 6:
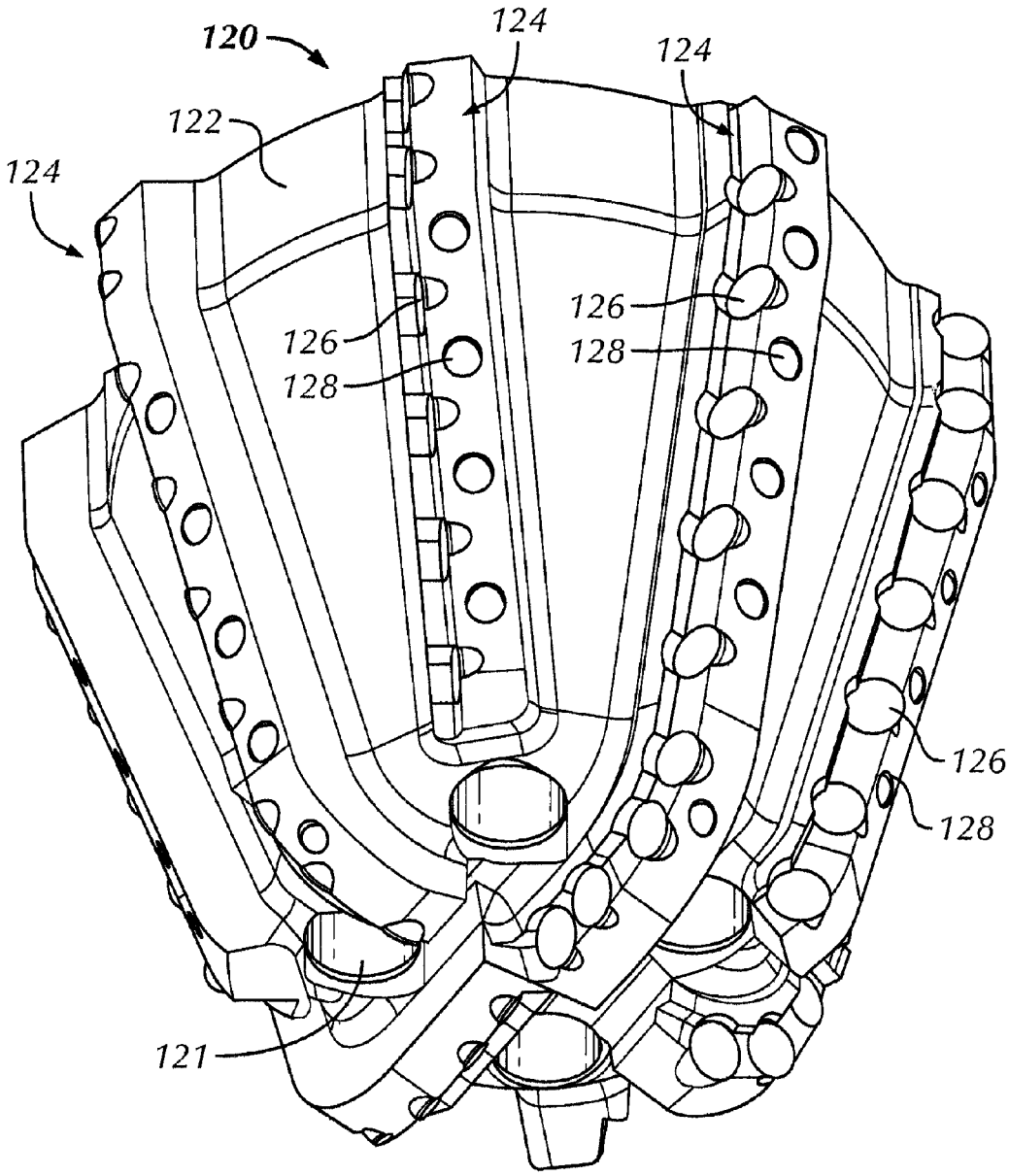
FIG. 6 shows a perspective view of a lead mill according to one embodiment disclosed herein.

While the embodiments shown in FIGS. 2, 4, and 5 generally show a conical diamond working surface, the present invention is not so limited. Rather, the apex of the diamond working surface may be rounded or flat, in various other embodiments. For example, the apex of the diamond working surface of the diamond layer 132 shown in FIG. 3D is more rounded (has a greater radius of curvature) than that the diamond layer 132 shown FIG. 3A. As shown in FIG. 6, a lead mill 120 includes a body 122 and a plurality of arched or blades 124 extending radially outward from body 122 to form the milling surface. Blades 124 include a plurality of cutting elements 126 and a plurality of diamond enhanced elements 128 staggered (and behind) cutting elements 126. In the embodiment shown in FIG. 6, diamond enhanced elements 128 have a dome or hemispherical shaped upper or working surface.

Further, in the various embodiments having both cutting elements 126 and diamond enhanced elements 128, it may be desirable to place diamond enhanced elements 128 in a proud or protruding manner with respect to cutting elements 126. For example, in the embodiment shown in FIG. 4, where diamond enhanced elements 128 are aligned with cutting elements 126 along the blade profile, the apex of diamond enhanced elements 128 protrudes a given distance in front of (in the direction of the leading face) the cutting end of cutting elements 126. Such distance may range, for example, from about 0.010 to 0.015 inches. Further, in the embodiment shown in FIGS. 2 and 6, one skilled in the art would appreciate that the apex of diamond enhanced elements may protrude radially outward from the leading edge of cutting element 126, and in such embodiments, the protrusion distance would be measured from the apex of the diamond enhanced element to the outermost periphery of the leading edge of the cutting element 126. In alternative embodiments, however, other protrusion distances or no protrusion distance may be selected.

Figure 7:
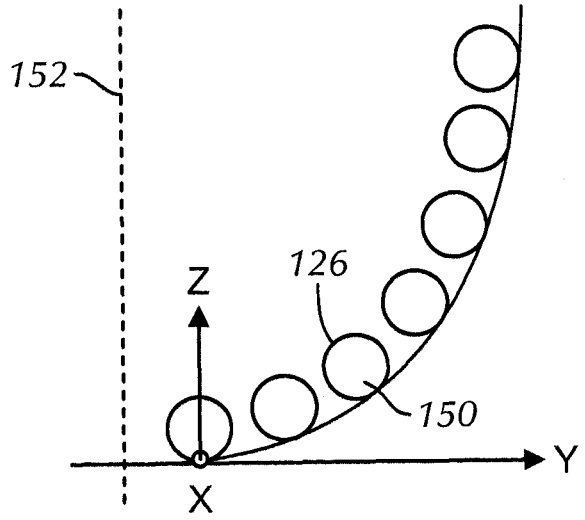
FIG. 7 shows a cutting element according to one embodiment of the present disclosure
Figure 8:
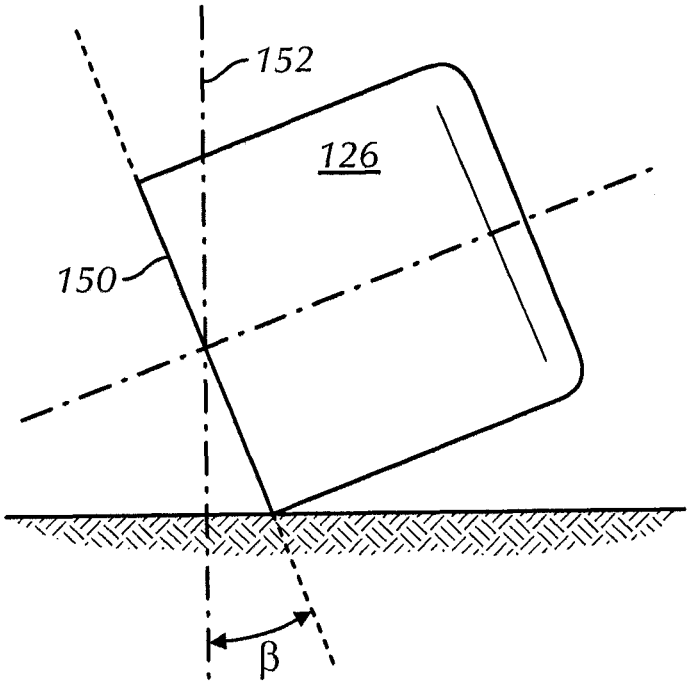
FIG. 8 shows a cutting element according to one embodiment of the present disclosure.

In addition to the presence or amount of protrusion, the placement of cutting elements 126 and diamond enhanced elements 128 may be described with respect to rake angle, including side rake and/or back rake. Side rake is defined as the angle between the plane of cutting face 150 and the radial plane of the bit (x-z plane), as shown in FIG. 7. When viewed along the z-axis, a negative side rake results from counter-clockwise rotation of the cutting element 126, and a positive side rake, from clockwise rotation. Back rake is defined as the angle subtended between the plane of the cutting face 150 of the cutting element 126 and a line parallel to the longitudinal axis 152 of the mill (not shown), as shown in FIG. 8. Such elements may be attached to the blade with the back and/or side rake angle so as to provide for a desired workface angle between the cutting face of the cutting elements (or tangential plane of the apex of diamond enhanced elements) and the workface (material being cut) as the elements engage the casing. The workface angle may be defined as the angle subtended between the plane of the cutting face of the cutting element and a line perpendicular to the contact point at the workface surface. Additionally, rake angle may be used to describe placement of the diamond enhanced insert on the blade, the plane tangential to the apex of the diamond enhanced insert may be used instead of the plane of the cutting element's cutting face.

Additionally, while the above embodiments show the use of the diamond enhanced element along the blades, it is also within the scope of the present disclosure that a diamond enhanced element may be located in the mill face center.

While each of the embodiments shown in the above figures shows a lead mill, embodiments disclosed herein may also relate to mill assemblies having a single mill attached to the end of a shank, and mill assemblies having a lead mill, one or more second mills, and a shank therebetween. As used herein, "second mill" refers to any type of mill, e.g., dress mill, watermelon mill, string mill, follow mill, etc., that may elongate and/or dress the window to full gage. One of ordinary skill in the art would recognize that in some embodiments, a mill assembly may include multiple second mills, i.e., a third mill, etc., or in other embodiments a mill assembly may instead include a lead mill followed by a motor or stabilizer attached to the shaft a distance above the lead mill, rather than a second mill.

The diamond enhanced elements having a non-planar diamond working surface may be included on any one of the various mill types without departing from the scope of the present disclosure. Further, any of such mills may be mounted on a shaft via connections (e.g. threaded connections) or the mill, including the body and blades, may be integral with the shaft. In one embodiment, a mill may be formed from a solid body having integral flow paths formed, for example, by machining, formed therein. In another embodiment, a mill may be formed from a mold via an infiltration or casting process.

As shown in the above figures, the blades are straight blades positioned about the perimeter of the mill body at substantially equal angular intervals. However, other blade arrangements may be used with embodiments of the present disclosed, and the embodiments shown in above figures are not intended to limit the scope of the embodiments disclosed herein. For example, the blades may be positioned at unequal angular intervals or be spiral instead of straight.

In a particular embodiment, a mill assembly such as the one disclosed herein may be included a one-trip milling/whipstock system, such as those described in U.S. Pat. Nos. 5,771,972, 6,102,123, 6,648,068, which are herein incorporated by reference in their entirety. Briefly, a one trip mill system, as shown in FIGS. 1A and 1B include a milling assembly generally designated as 30 and a whipstock assembly generally designated as 60 that includes a whipstock 44. The mill assembly 30 includes a lead mill generally designated as 32, which is attached to the bottom end of a shank or shaft 31. Located above and spaced from the lead mill 32 is, for example, a second or follow mill 33 that is also mounted to the shaft 31. The upper end of the shaft 31 is either threadably connected to a drill string or threaded to another subassembly (not shown). A tubular member 27 may form the shaft 31 on which mills 32 and 33 are mounted. Tubular member 27 may include a lower reduced diameter portion on which mill 32 is disposed with mill 33 being disposed on the fill diameter of tubular member 27. This reduction in diameter provides flexibility between mills 32 and 33 during the milling process.

The whipstock 44 has a diameter $D_W$ that approximates the inside diameter of the interior wall of casing 11 which allows whipstock 44 to be lowered through cased borehole 9. Whipstock 44 also includes a profiled ramp surface 28 having a curved or arcuate cross section and multiple surfaces, each of the multiple surfaces forming its own angle with the axis 26 of whipstock 44. Profiled ramp surface 28 includes a starter surface 45 having a steep angle preferably 15°, a vertical surface 46 preferably parallel to the axis 26, an initial ramp surface 47 having a standard angle ranging from about 0.5 to 3°, a "kick out" surface 48 having a steep angle preferably 15°, and a subsequent ramp surface 49 having a standard angle ranging from about 0.5 to 3°. It should be appreciated that these angles may vary. For example, the starter ramp surface 45 may have an angle A in the range of 1 to 45° in one embodiment, 2 to 30° in another embodiment, 3 to 15° in yet another embodiment, and about 15° in still another embodiment. The vertical surface 46 may have a length approximately equal to or greater than the distance between mills 32 and 33. In a particular embodiment, ramp surfaces 46, 49 may range from greater than zero to 15°. One of ordinary skill in the art would recognize that the surfaces angles may be selected depending on the desired window dimensions.

The backside 62 of the whipstock 44, especially adjacent the upper end of the whipstock 44, is contoured to conform to the inside diameter $D_I$ of the interior wall of the pipe casing 11 for stability of the top of the whipstock 44. The opposite lower end of the whipstock 44 is secured to, for example, a hydraulically actuated anchor (not shown). A typical anchor is shown in U.S. Pat. No. 5,657,820, incorporated herein by reference in its entirety.

The mill 32 and whipstock 44 disclosed herein are configured such that the mill 32 tends to cut the wall of the casing 11 and not the whipstock 44. To achieve this objective, various factors are taken into consideration including the contact area and contact stress between the mill 32, casing 11, and whipstock 44 and the cutability of the metal of the casing and of the metal used for the whipstock 44.

Use of the elements described herein may render the mill as suitable for the dual functions of milling steel casing and drilling rock formation. In a particular embodiment, the casing may be formed of a corrosion resistant alloy, and the elements described herein may render the mill as suitable for both milling a window in the CRA as well as drilling rock. Thus, one skilled in the art would appreciate that the mills of the present disclosure may be used in conjunction with a bottom hole assembly which stabilizes the cutting tool, provides the motive force for rotating the cutting tool, and after milling through casing, directionally controls the movement of the cutting tool in rock formation.

Further, reference to the term "diamond" (and its use in the elements of the present disclosure) is understood to include polycrystalline diamond (natural or synthetic), thermally stable diamond (formed such as by leaching), vapor deposited diamond, silicon bonded diamond, diamond impregnation, cubic boron nitride, etc. Thus, no limitation exists on the type of diamond or diamond-like materials that may be used.

Further, while many of the embodiments of the present disclosure described milling through a casing, it is also within the scope of the present disclosure that the mill may be used to sidetrack through an open hole completion.

Embodiments of the present disclosure may provide at least one of the following advantages. As described above, as the mill cutting structure meets the casing wall, the cutting structure typically encounters severe vibrations that frequently lead to cracks in the cutters. Such cracks may lead to failure of the cutters, reducing the life of the mill and likely preventing the mill from being used to drill through the sidetracked, secondary borehole (through the earth formation) after the window is milled. The use of the diamond enhanced elements having a non-planar diamond working surface may provide protection from vibration induced damage to the cylindrical cutting elements by being placed in a position that protrudes slightly more than cutting elements. Additionally, the strategic placement of both element types may provide maximum milling action, as well as drilling action once the mill reaches the formation. Further, when using conical shaped diamond enhanced elements, even as the cone point becomes blunt, the element may continue to provide milling and/or drilling action. Further, in the initial milling stages, protrusion of the diamond enhanced element also result in creation of initial gouges in the casing, thus providing better grip for the cylindrical cutting element as they engage with the casing. Use of a diamond enhanced element in the mill face center may provide an anti-coring effect.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A mill for milling a window through metal casing in a well bore, comprising:

a body having a plurality of blades;

a plurality of cylindrically bodied cutting elements on said blades; and at least one diamond enhanced element having a non-planar diamond working surface on said blades;

wherein at least one of the cylindrically bodied cutting elements and at least one of the diamond enhanced elements are on the same blade;

wherein said cutting elements initiate cutting into said casing and mill said window into said well bore.

2. The mill of claim 1, wherein the cylindrically bodied cutting elements comprises a substrate and a diamond layer disposed on the substrate.

3. The mill of claim 1, wherein the at least one diamond enhanced element is inserted into holes formed in the blades.

4. The mill of claim 1, wherein the at least one diamond enhanced element is secured in cutter pockets formed along a leading face of the blade.

5. The mill of claim 1, wherein the at least one diamond enhanced element is inserted into a hole in the mill face center.

6. The mill of claim 1, wherein the non-planar diamond working surface is conical shaped.

7. The mill of claim 1, wherein the non-planar diamond working surface is dome-shaped.

8. The mill of claim 1, wherein the diamond enhanced elements protrude with respect to the cylindrically bodied cutting elements.

9. The mill of claim 1, wherein the at least one of the diamond enhanced elements is secured to the blade such that the plane tangential to an apex of the diamond enhanced element is about 90 degrees to the plane of a working surface of the at least one of the cylindrically bodied cutting elements.

10. The mill of claim 1, wherein the at least one of the diamond enhanced elements is secured to the blade such that an apex of the diamond enhanced element protrudes radially outward from the blade, and wherein the at least one of the cylindrically bodied cutting elements is secured to a leading edge of the blade.

11. The mill of claim 10, wherein the diamond enhanced elements protrude a distance ranging from about 0.01 to 0.015 inches farther than the cylindrically bodied cutting elements.

12. The mill of claim 1, wherein the at least one of the diamond enhanced elements is secured to a leading edge of the blade, and the at least one of the cylindrically bodied cutting elements is secured to the leading edge of the blade, wherein an apex of the diamond enhanced element protrudes a distance from the leading edge farther than the cylindrically bodied cutting elements.

13. The mill of claim 12, wherein the distance ranges from about 0.01 to 0.015 inches.

14. The mill of claim 1, wherein the at least one of the diamond enhanced elements is secured to the blade such that a plane tangential to an apex of the diamond enhanced elements is co-planar with the plane of a working surface of the at least one of the cylindrically bodied cutting elements.

15. The mill of claim 1, wherein the cylindrically bodied cutting elements comprise:

a body; and a cutting face;

wherein the body and the cutting face comprise cemented tungsten carbide.

16. The mill of claim 1, wherein each of the at least one diamond enhanced element is positioned rearward the at least one cylindrically bodied cutting element from a leading edge of the blade.

17. A method of milling a window in a casing in a wellbore, comprising:

rotating a mill having a body with a plurality of blades, a plurality of cylindrically bodied cutting elements on the blades, and a plurality of diamond enhanced elements having a non-planar diamond working surface on said blades, wherein at least one blade has a diamond enhanced element and a cylindrically bodied cutting element disposed thereon;

cutting a window in the metal casing with the mill; and passing the mill through the window.

18. The method of claim 17, wherein the cylindrically bodied cutting elements comprises a substrate and a diamond layer disposed on the substrate.

19. The method of claim 17, wherein the diamond enhanced elements are inserted into holes formed in the blades.

20. The method of claim 17, wherein the diamond enhanced elements are secured in cutter pockets formed along a leading face of the blade.

21. The method of claim 17, wherein the non-planar diamond working surface is conical shaped.

22. The method of claim 17, wherein the non-planar diamond working surface is dome-shaped.

23. The method of claim 17, wherein the diamond enhanced elements protrude with respect to the cylindrically bodied cutting elements.

24. The method of claim 17, further comprising:

drilling a secondary borehole with the mill.

25. The method of claim 17, further comprising:

engaging a lead mill of a mill assembly against an interior surface of the casing, the lead mill having the plurality of diamond enhanced elements with the non-planar diamond working surface;

rotating the mill assembly;

moving the mill assembly along a surface of a whipstock assembly as the lead mill cuts the window in the casing, thereby deflecting the lead mill and shaft outwardly through the window in the casing; and engaging a second mill of the mill assembly against the window in the casing.

26. The method of claim 25, wherein the lead mill further comprises a plurality of cylindrically bodied cutting elements on said blades.

27. The method of claim 17, wherein the casing comprises a corrosion resistant alloy.

* * * * *